US011476029B2

(12) United States Patent
Takezawa et al.

(10) Patent No.: US 11,476,029 B2
(45) Date of Patent: Oct. 18, 2022

(54) COIL COMPONENT

(71) Applicant: Murata Manufacturing Co., Ltd., Kyoto-fu (JP)

(72) Inventors: Kaori Takezawa, Nagaokakyo (JP); Kohei Kobayashi, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 620 days.

(21) Appl. No.: 16/438,276

(22) Filed: Jun. 11, 2019

(65) Prior Publication Data

US 2020/0005981 A1 Jan. 2, 2020

(30) Foreign Application Priority Data

Jun. 29, 2018 (JP) ..... JP2018-123775

(51) Int. Cl.

| | |
|---|---|
| ***H01F 17/04*** | (2006.01) |
| ***H01F 27/29*** | (2006.01) |
| ***H01F 41/10*** | (2006.01) |
| ***H01F 27/24*** | (2006.01) |
| ***H01F 27/28*** | (2006.01) |
| ***H01F 27/00*** | (2006.01) |

(52) U.S. Cl.

CPC ..... *H01F 17/045* (2013.01); *H01F 27/006* (2013.01); *H01F 27/24* (2013.01);

(Continued)

(58) Field of Classification Search

CPC .... H01F 17/04; H01F 17/045; H01F 27/2823; H01F 27/2828; H01F 2017/0093;

(Continued)

(56) References Cited

U.S. PATENT DOCUMENTS 6,778,055 B1 * 8/2004 Wang ..... H01F 17/045 336/208
2011/0006867 A1 * 1/2011 Oki ..... H01F 27/292 336/192

(Continued)

FOREIGN PATENT DOCUMENTS

JP H10-92625 A 4/1998
JP H10-312922 A 11/1998

(Continued)

OTHER PUBLICATIONS

An Office Action; "Notice of Reasons for Refusal," mailed by the Japanese Patent Office dated Oct. 13, 2020, which corresponds to Japanese Patent Application No. 2018-123775 and is related to U.S. Appl. No. 16/438,276 with English language translation.

(Continued)

*Primary Examiner* — Tszfung J Chan
(74) *Attorney, Agent, or Firm* — Studebaker & Brackett PC

(57) ABSTRACT

A coil component includes a drum core and first and second wires. The first wire includes a first extending portion. The second wire includes a third extending portion. The first and third extending portions are not in contact with each other. Each of the first and second wires includes a coat including a first region and a second region. The coat in the first and third extending portions is the second region at least in part. The coat is the first region at a contacting point where the first and second wires are in contact for the first time from a first flange portion in the drum core.

20 Claims, 4 Drawing Sheets

(52) U.S. Cl.
CPC ..... *H01F 27/2823* (2013.01); *H01F 27/29* (2013.01); *H01F 41/10* (2013.01); *H01F 2017/046* (2013.01); *H01F 2017/048* (2013.01)

(58) Field of Classification Search
CPC ..... H01F 27/29; H01F 27/292; H01F 27/38; H01F 27/046; H01F 2017/048; H01F 27/006; H01F 27/24; H01F 41/10
USPC ..... 336/83, 192
See application file for complete search history.

(56) References Cited

U.S. PATENT DOCUMENTS

| | | | | |
|---|---|---|---|---|
| 2015/0042436 | A1* | 2/2015 | Arimitsu ..... | H01F 17/045 336/192 |
| 2017/0365399 | A1* | 12/2017 | Kobayashi ..... | H01F 27/2828 |

FOREIGN PATENT DOCUMENTS

| | | | | |
|---|---|---|---|---|
| JP | H11-204346 | A | | 7/1999 |
| JP | 2002246244 | A | * | 8/2002 |
| JP | 2002313646 | A | * | 10/2002 |
| JP | 2009-094389 | A | | 4/2009 |
| JP | 2009094389 | A | * | 4/2009 |

OTHER PUBLICATIONS

An Office Action mailed by China National Intellectual Property Administration dated Dec. 3, 2021 which corresponds to Chinese Patent Application No. 201910387998.8 and is related to U.S. Appl. No. 16/438,276 with English language translation.

* cited by examiner

COIL COMPONENT

CROSS-REFERENCE TO RELATED APPLICATION

This application claims benefit of priority to Japanese Patent Application No. 2018-123775, filed Jun. 29, 2018, the entire content of which is incorporated herein by reference.

BACKGROUND

Technical Field

The present disclosure relates to coil components and in particular to a coil component including a first wire and a second wire wound around a winding core portion.

Background Art

One example coil component is a common mode choke coil. An example of the common mode choke coil described in Japanese Unexamined Patent Application Publication No. 11-204346 includes a drum core including a winding core portion and first and second flange portions on mutually opposite end portions of the winding core portion, respectively, a first wire and a second wire wound around the winding core portion, a first terminal electrode and a third terminal electrode spaced apart from each other on the first flange portion, and a second terminal electrode and a fourth terminal electrode spaced apart from each other on the second flange portion.

The first wire includes a first end portion connected to the first terminal electrode and a second end portion connected to the second terminal electrode. The second wire includes a first end portion connected to the third terminal electrode and a second end portion connected to the fourth terminal electrode.

Each of the first and second wires includes a linear central conductor and a coat made of a resin and covering the peripheral surface of the central conductor. The connections between the first and second wires and the first to fourth terminal electrodes may be formed by using, for example, a thermocompression bonding process.

A heater chip is used in the thermocompression bonding process. The heater chip is arranged in a position opposed to the terminal electrode such that the wire is partly interposed therebetween and is pressed toward the terminal electrode by pressure welding. As a result of this action, as illustrated in the above-mentioned Japanese Unexamined Patent Application Publication No. 11-204346 and Japanese Unexamined Patent Application Publication No. 10-312922, the coat in the wire is removed by heat produced by the heater chip, and the central conductor in the wire becomes connected to the terminal electrode.

SUMMARY

In the above-described thermocompression bonding process, it is necessary to raise the temperature of the heater chip to some extent in order to achieve appropriate connection between the central conductor and the terminal electrode. With such a high temperature, the coat in the wire is removed not only at the connection portion connected to the terminal electrode in the wire but also at the portion between that connection portion and the winding core portion. At the portion in the wire where the coat is removed and the central conductor is exposed, electrical shortings or insufficient insulation may easily occur. As example measures to address the electrical shortings or insufficient insulation, an embodiment for the flange portion on which the terminal electrode is disposed is described in Japanese Unexamined Patent Application Publication No. 11-204346.

The measures described in the above-mentioned Japanese Unexamined Patent Application Publication No. 11-204346 are devised to avoid inconvenience at the portion where the central conductor in the wire is exposed and does not expect problems of electrical shortings and insufficient insulation occurring in at the portion where the coat remains in the wire. Thus, no measures to solve such problems are dealt with.

The inventors of the present disclosure noted that the coat remaining in the wires was sometimes modified. The inventors of the present disclosure discovered the possibility that if a voltage caused by, for example, a potential difference occurring between the first wire and second wire in contact with each other is applied to that modified region, that region may be hydrolyzed by moisture contained in the environment, and the dielectric strength and electrical insulation properties may deteriorate. That is, the inventors found an issue in which even the portion where the coat remains in the wires may encounter problems caused by change over time, such as electrical shortings and insufficient insulation.

Thus, the present disclosure provides a coil component that includes a drum core, a first wire, a second wire, a first terminal electrode, a third terminal electrode, a second terminal electrode, and a fourth terminal electrode. The drum core includes a winding core portion extending in an axial direction, a first flange portion, and a second flange portion. The first and second flange portions are disposed on opposite end portions of the winding core portion. Each of the first and second wires includes a linear central conductor and a coat made of resin and covering a peripheral surface of the central conductor. The first and third terminal electrodes are disposed on the first flange portion. The second and fourth terminal electrodes are disposed on the second flange portion.

The first wire includes a first connection portion connected to the first terminal electrode, a first winding portion wound around the winding core portion, a second connection portion connected to the second terminal electrode and being opposite to the first connection portion, a first extending portion between the first connection portion and the first winding portion, and a second extending portion between the second connection portion and the first winding portion.

The second wire includes a third connection portion connected to the third terminal electrode, a second winding portion wound around the winding core portion, a fourth connection portion connected to the fourth terminal electrode and being opposite to the third connection portion, a third extending portion between the third connection portion and the second winding portion, and a fourth extending portion between the fourth connection portion and the second winding portion. The first extending portion and the third extending portion are not in contact with each other.

The coat includes a first region made of a first resin containing a urethane group and a second region made of a second resin containing no urethane group. The coat in the first extending portion and the third extending portion is the second region at least in part. The coat at a first contacting point where the first wire and the second wire are in contact for the first time from the first flange portion is the first region.

In the above-described coil component, because of the presence of the second region in the coat in the first and third extending portions, the reliability of connection between the first terminal electrode and the first connection portion and that between the third terminal electrode and the third connection portion can be ensured.

Because the coat is the first region at the first contacting point, the modification of the coat proceeding from the first connection portion and the third connection portion stops in locations between the first contacting point and the first flange portion and does not proceed to sections of the first and second winding portions after the first contacting point, the sections being the ones in which a potential difference may occur. Accordingly, in the above-described coil component, even in portions where the coat remains in the first and second wires, the occurrence of problems caused by change over time, such as electrical shortings and insufficient insulation, can be reduced.

Other features, elements, characteristics and advantages of the present disclosure will become more apparent from the following detailed description of the present disclosure with reference to the attached drawings.

DETAILED DESCRIPTION

Figure 1:
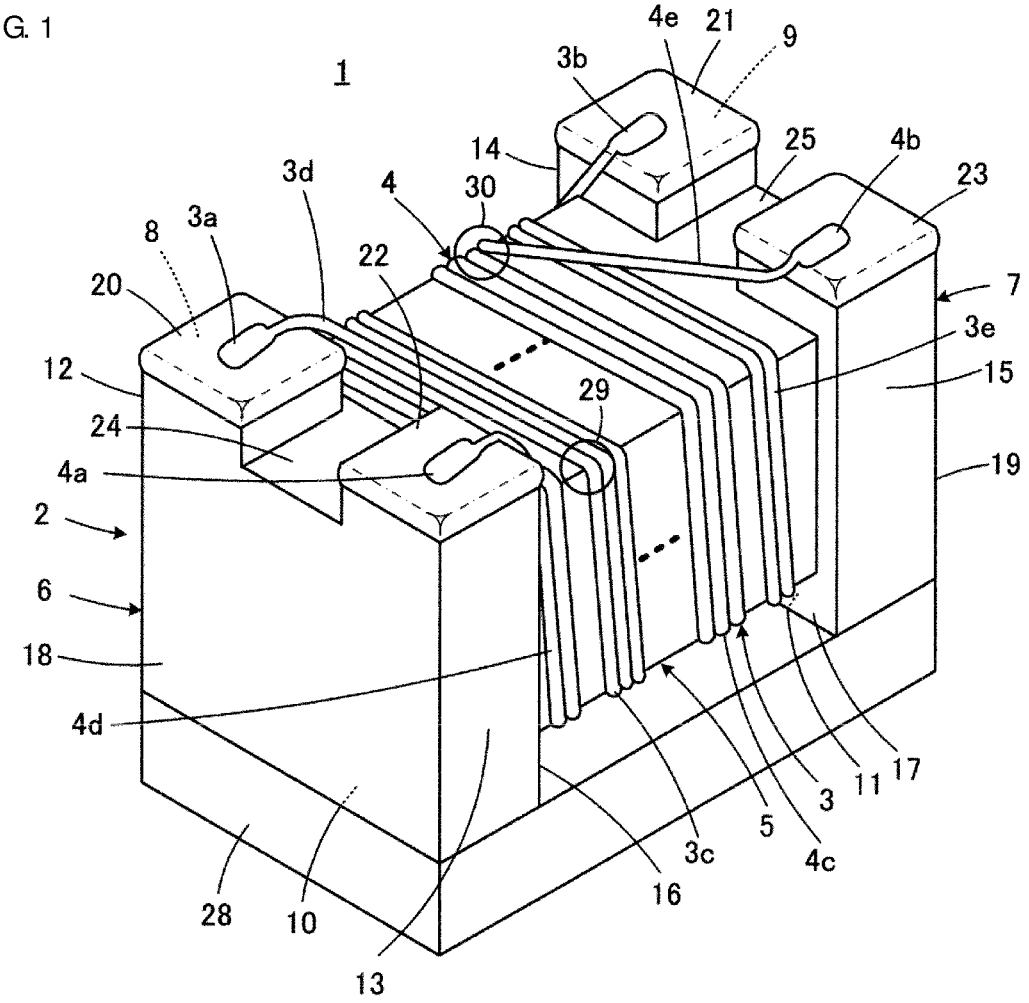
FIG. 1 is a perspective view that illustrates an external appearance of a coil component according to a first embodiment as seen from a mounting surface side.
Figure 2:
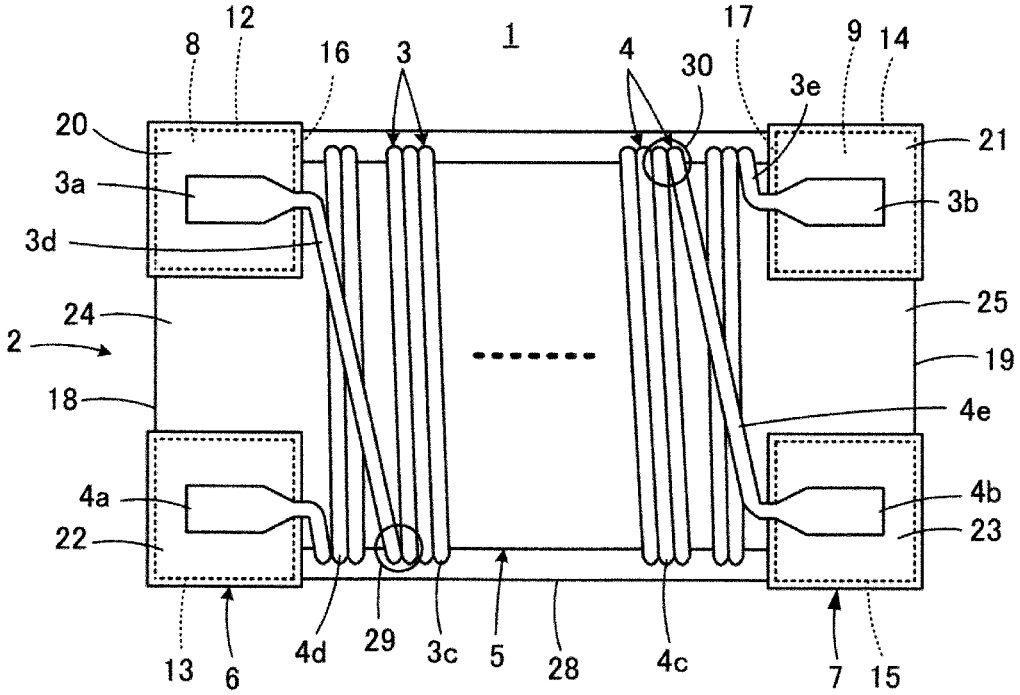
FIG. 2 is a bottom view that illustrates the external appearance of the coil component illustrated in FIG. 1 as seen from the mounting surface side.

A coil component 1 according to a first embodiment is described with reference to FIGS. 1 to 4. FIGS. 1 and 2 illustrate a state where a surface to be opposed to a mounting substrate of each of the coil component 1 and a drum core 2 faces upward. One example of the illustrated coil component 1 may constitute a common mode choke coil.

The drum core 2 included in the coil component 1 includes a winding core portion 5 extending along the axial direction and around which two wires 3 and 4 are arranged, a first flange portion 6, and a second flange portion 7. The first flange portion 6 and second flange portion 7 are disposed on first end portion and second end portion of the winding core portion 5, respectively. The first and second end portions are positioned on mutually opposite sides in the axial direction of the winding core portion 5. The drum core 2 can be made of a nonconductive material, more specifically, a nonmagnetic substance, such as alumina, a magnetic substance, such as ferrite, or a resin. It may preferably be made of a ceramic material, such as alumina or ferrite.

The winding core portion 5 and the first and second flange portions 6 and 7 included in the drum core 2 may have a substantially quadrangular prism shape having a substantially quadrangle shape in cross section. The ridge portions of each of the winding core portion 5 and the first and second flange portions 6 and 7, which have the substantially quadrangular prism shape, may preferably be rounded.

The first flange portion 6 includes a first flange portion bottom surface 8 facing a mounting substrate when the coil component 1 is mounted thereon, a first flange portion top surface 10 facing the direction opposite to the first flange portion bottom surface 8, a first inner end surface 16 facing the winding core portion 5, a first outer end surface 18 facing an outer side opposite to the first inner end surface 16, the first inner end surface 16 and first outer end surface 18 extending in a direction substantially orthogonal to the mounting substrate, and first flange portion side surfaces 12 and 13 facing mutually opposite lateral directions. The first inner end surface 16 and first outer end surface 18 are substantially perpendicular to the first flange portion side surfaces 12 and 13.

The second flange portion 7 is similar to the first flange portion 6 and includes a second flange portion bottom surface 9 facing the mounting substrate side when the coil component 1 is mounted thereon, a second flange portion top surface 11 facing the direction opposite to the second flange portion bottom surface 9, a second inner end surface 17 facing the winding core portion 5, a second outer end surface 19 facing an outer side opposite to the second inner end surface 17, the second inner end surface 17 and second outer end surface 19 extending in the direction substantially orthogonal to the mounting substrate, and second flange portion side surfaces 14 and 15 facing mutually opposite lateral directions.

A first terminal electrode 20 and a third terminal electrode 22 are disposed on the first flange portion bottom surface 8 of the first flange portion 6 and are aligned in a direction substantially perpendicular to the axial direction. A second terminal electrode 21 and a fourth terminal electrode 23 are disposed on the second flange portion bottom surface 9 of the second flange portion 7 and are aligned in the direction substantially perpendicular to the axial direction. A recessed portion 24 recessed along the axial direction is disposed in the first flange portion bottom surface 8 of the first flange portion 6 and separates the first terminal electrode 20 and third terminal electrode 22 from each other. A recessed portion 25 recessed along the axial direction is disposed in the second flange portion bottom surface 9 of the second flange portion 7 and separates the second terminal electrode 21 and fourth terminal electrode 23 from each other.

The above-described terminal electrodes 20 to 23 may be formed by, for example, applying conductive paste containing silver as its conductive component to a predetermined area, baking it, thus obtaining a conductive thick film, and coating the conductive thick film with nickel plating and tin plating.

Figure 3:
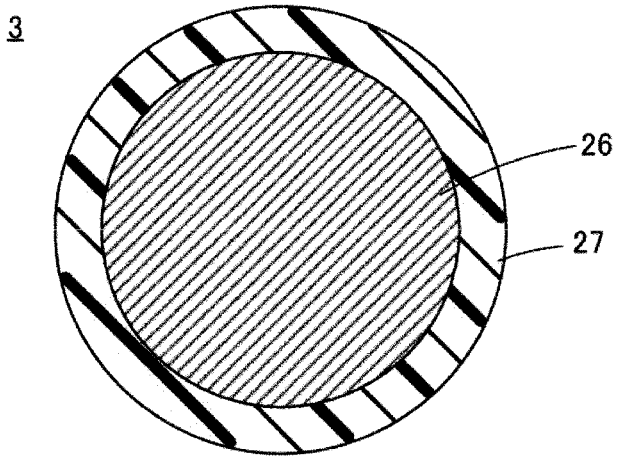
FIG. 3 is an enlarged view of a first wire included in the coil component illustrated in FIGS. 1 and 2.

Each of the wires 3 and 4 prepared for manufacturing the coil component 1 includes a linear central conductor 26 and a coat 27 covering the peripheral surface of the central conductor 26. The central conductor 26 and coat 27 of the first wire 3 are illustrated in FIG. 3. The diameter of the central conductor 26 may preferably be not less than about 28 μm and not larger than about 35 μm (i.e., from about 28 μm to about 35 μm). The thickness of the coat 27 may preferably be not less than about 3 μm and not larger than about 6 μm (i.e., from about 3 μm to about 6 μm).

One example of the central conductor 26 may be made of a copper wire. The coat 27 may be made of a resin containing a urethane group, such as polyurethane (e.g., imide-modified polyurethane). With this coat 27, high dielectric strength and electrical insulation properties can be provided to the wires 3 and 4. Accordingly, in states where the coil component 1 is actually operating, the first wire 3 and second wire 4 can exhibit sufficient dielectric strength and electrical insulation properties to a potential difference between the first wire 3 and the second wire 4 arising from differential mode signals in the common mode choke coil.

The first wire 3 and second wire 4 are spirally wound in the same direction around the winding core portion 5. In the state illustrated in FIGS. 1 and 2, in the main portion, the first wire 3 and second wire 4 are bifilarly wound such that they are alternately arranged and substantially parallel to each other in the axial direction of the winding core portion 5. The first wire 3 and second wire 4 may be wound as double layers such that one of them is wound as an inner layer and the other is wound as an outer layer.

The coil component 1 may further include a planar core 28 extending between the first flange portion top surface 10 of the first flange portion 6 and the second flange portion top surface 11 of the second flange portion 7. The planar core 28 may be made of a nonconductive material, more specifically, a nonmagnetic substance, such as alumina, a magnetic substance, such as ferrite, or a resin, as in the case of the drum core 2. The planar core 28 is fixed to the drum core 2 by an adhesive.

Figure 4:
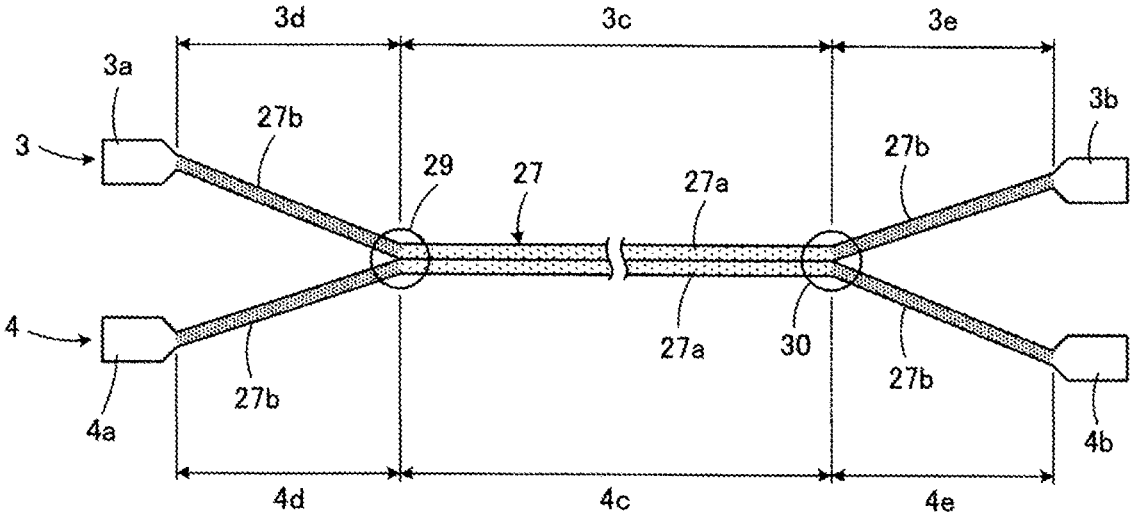
FIG. 4 schematically illustrates a state where the first wire and a second wire included in the coil component illustrated in FIGS. 1 and 2 are unfolded.

Next, the details of an arrangement state of the first wire 3 and second wire 4 to the drum core 2 are described. FIG. 4 schematically illustrates a state where the first wire 3 and second wire 4 arranged to the drum core 2 are unfolded.

The first wire 3 includes a first connection portion 3*a* connected to the first terminal electrode 20, a first winding portion 3*c* wound around the winding core portion 5, a second connection portion 3*b* connected to the second terminal electrode 21 and being opposite to the first connection portion 3*a*, a first extending portion 3*d* between the first connection portion 3*a* and first winding portion 3*c*, and a second extending portion 3*e* between the second connection portion 3*b* and first winding portion 3*c*.

The second wire 4 is substantially the same as the first wire 3. The second wire 4 includes a third connection portion 4*a* connected to the third terminal electrode 22, a second winding portion 4*c* wound around the winding core portion 5, a fourth connection portion 4*b* connected to the fourth terminal electrode 23 and being opposite to the third connection portion 4*a*, a third extending portion 4*d* between the third connection portion 4*a* and second winding portion 4*c*, and a fourth extending portion 4*e* between the fourth connection portion 4*b* and second winding portion 4*c*.

The above-described connections between the first connection portion 3*a* and first terminal electrode 20, between the second connection portion 3*b* and second terminal electrode 21, between the third connection portion 4*a* and third terminal electrode 22, and between the fourth connection portion 4*b* and fourth terminal electrode 23 may be formed by using, for example, thermocompression bonding. In the connection portions 3*a*, 3*b*, 4*a*, and 4*b*, the coats 27 in the wires 3 and 4 are removed by heat in the thermocompression bonding.

As schematically illustrated in FIG. 4, the first connection portion 3*a* and third connection portion 4*a*, the second connection portion 3*b* and fourth connection portion 4*b*, the first extending portion 3*d* and third extending portion 4*d*, and the second extending portion 3*e* and fourth extending portion 4*e* are not in contact with each other, and the first wire 3 and second wire 4 are spaced apart from each other. In contrast, the first wire 3 and second wire 4 are in contact with each other at least in part in the first winding portion 3*c* and second winding portion 4*c*. This arrangement state of the first wire 3 and second wire 4 can also be seen in FIGS. 1 and 2.

As previously described with reference to FIG. 3, the coat 27 in each of the first wire 3 and second wire 4 prepared for manufacturing the coil component 1 is made of a resin containing a urethane group, such as polyurethane. However, at a stage where the connections between the wires 3 and 4 and the terminal electrodes 20 to 23 by thermocompression bonding are completed, as schematically illustrated in FIG. 4, the coat 27 is in a state where in addition to a first region 27*a* made of a first resin containing a urethane group, such as polyurethane, a second region 27*b* made of a second resin containing no urethane group, such as polyester, is present. Whether a urethane group is contained or not can be determined by, for example, measuring an infrared spectrum by using a Fourier transform infrared spectrometer (FTIR).

The second resin constituting the second region 27*b* is made of a resin in which the urethane group contained in the first resin constituting the first region 27*a* is modified. This modification arises from thermal reaction in which the first resin containing the urethane group loses the urethane group due to heat provided in thermocompression bonding for connecting the connection portions 3*a*, 3*b*, 4*a*, and 4*b* in the wires 3 and 4 to the terminal electrodes 20 to 23. Accordingly, in the winding portions 3*c* and 4*c*, which are relatively distant from the connection portions 3*a*, 3*b*, 4*a*, and 4*b* in the wires 3 and 4, the coat 27 is the first region 27*a*. In contrast, in the first extending portion 3*d*, second extending portion 3*e*, third extending portion 4*d*, and fourth extending portion 4*e*, which are relatively near the connection portions 3*a*, 3*b*, 4*a*, and 4*b* in the wires 3 and 4 and are affected by heat in thermocompression bonding, the coat 27 is the second region 27*b*.

In FIG. 4, the first region 27*a* and second region 27*b* are distinctively illustrated by using different patterns. However, in the first extending portion 3*d*, second extending portion 3*e*, third extending portion 4*d*, and fourth extending portion 4*e*, in which the second region 27*b* is present, the first region 27*a* may be present in part in the coat.

After the position at which the winding portions 3*c* and 4*c*, where the first wire 3 and second wire 4 come into contact with each other at least in part, start, that is, after a first contacting point 29 where the first wire 3 and second wire 4 are in contact for the first time as seen from the first flange portion 6, specifically in a direction from the extending portions 3*d* and 4*d* to the winding portions 3*c* and 4*c*, the coat 27 is the first region 27*a*.

In this configuration, in the first extending portion 3*d* and third extending portion 4*d*, the second region 27*b* is present in the coat 27 and an adequate thermal history can be assured, and the reliability of connection between the first terminal electrode 20 and the first connection portion 3*a* and the reliability of connection between the third terminal electrode 22 and the third connection portion 4*a* can be secured.

Because the coat 27 is the first region 27*a* at the first contacting point 29 as seen from the first flange portion 6, the modification of the coat 27 proceeding from the first connection portion 3*a* and third connection portion 4*a* stops at locations between the first contacting point 29 and the first flange portion 6, and it does not proceed to the first winding portion 3*c* and second winding portion 4*c*, where a potential difference may occur. Accordingly, the coil component 1 can reduce the occurrence of problems caused by change over time, such as electrical shortings and insufficient insulation, even in the portions where the coat 27 remains in the first wire 3 and second wire 4. Therefore, the coil component 1 can be highly reliable.

In the present embodiment, the second resin, which constitutes the second region 27*b* and does not contain a urethane group, is typically made of a resin in which the urethane group contained in the first resin, which forms the first region 27*a*, is modified. Such a modification arises from thermal reaction in which the first resin, which contains the urethane group, loses the urethane group due to heat provided in thermocompression bonding for connecting the wires 3 and 4 to the terminal electrodes 20 to 23. For example, in locations remote from the first contacting point 29, at which the first wire 3 and second wire 4 are in contact for the first time as seen from the first flange portion 6, the effect of the heat provided in thermocompression bonding for connecting the first wire 3 to the first terminal electrode 20 is further reduced, and thus the first region 27*a*, which is made of the first resin, which contains the urethane group, in the coat 27 is maintained.

The embodiment described above with reference to FIGS. 1 to 4 further has the following characteristics.

In the above description, at the first contacting point 29, where the first wire 3 and second wire 4 are in contact for the first time as seen from the first flange portion 6, the coat 27 is the first region 27*a*, which is made of the first resin, which contains the urethane group. This configuration is similar to the side of the second flange portion 7. That is, the coat 27 is also the first region 27*a*, which is made of the first resin, which contains the urethane group, at a second contacting point 30 where the first wire 3 and second wire 4 are in contact for the first time as seen from the second flange portion 7. This further enhances the reliability of the coil component 1.

In the second winding portion 4*c*, for example, about two turns of wire are wound between the first contacting point 29 and the first flange portion 6. In the first winding portion 3*c*, for example, about two turns of wire are wound between the second contacting point 30 and the second flange portion 7. That is, in either one of the first winding portion 3*c* and second winding portion 4*c*, about one or more turns of wire may preferably be wound between the first contacting point 29 and the first flange portion 6, and about one or more turns of wire may preferably be wound between the second contacting point 30 and the second flange portion 7. Here, the winding of about one or more turns of wire may be winding of about three or more turns of wire.

In the above-described configuration, the contacting points 29 and 30, where the first wire 3 and second wire 4 are in contact for the first time, can be located in positions remote from the connection portions 3*a*, 3*b*, 4*a*, and 4*b*, to which heat for thermocompression bonding is provided. As previously described, the configuration in which the first region 27*a* in the coat 27 is positioned in the winding portions 3*c* and 4*c* and the second region 27*b* is positioned in only the extending portions 3*d*, 3*e*, 4*d*, and 4*e* is generally realized by adjusting temperatures and time used in the thermocompression bonding process. As in the present embodiment, when the contacting points 29 and 30, where the first wire 3 and second wire 4 are in contact for the first time, are located in positions actively remote from the connection portions 3*a*, 3*b*, 4*a*, and 4*b*, to which heat for thermocompression bonding is provided, the following advantages are obtainable.

The modification of the coat 27 proceeding from the first to fourth connection portion 3*a*, 3*b*, 4*a*, and 4*b* can be stopped at locations between the first contacting point 29 and the first flange portion 6 and can be stopped at locations between the second contacting point 30 and the second flange portion 7, and it can be reliably prevented from proceeding to the first winding portion 3*c* and second winding portion 4*c*, in which a potential difference may occur. Accordingly, even in portions where the coat 27 remains in the first wire 3 and second wire 4, the occurrence of problems caused by change over time, such as electrical shortings and insufficient insulation, can be reduced, and thus, the coil component 1 can be more highly reliable.

By locating in remote positions described above, even when temperatures in the thermocompression bonding process are further increased, the arrival of heat at the contacting points 29 and 30, where the first wire 3 and second wire 4 are in contact for the first time, can be delayed, and thus, the temperatures in the thermocompression bonding process can be increased. Consequently, the strength of coupling between the connection portion 3*a*, 3*b*, 4*a*, and 4*b* and the terminal electrodes 20 to 23 can be enhanced.

In the above-described first embodiment, at least one turn of wire solely wound on the winding core portion 5 is the second winding portion 4*c* in the section between the first contacting point 29 and the first flange portion 6 and is the first winding portion 3*c* in the section between the second contacting point 30 and the second flange portion 7. In place of this configuration, it may be the first winding portion 3*c* in the section between the first contacting point 29 and the first flange portion 6 and be the second winding portion 4*c* in the section between the second contacting point 30 and the second flange portion 7. At least one turn of wire solely wound on the winding core portion 5 may be in only either one of the section between the first contacting point 29 and the first flange portion 6 and the section between the second contacting point 30 and the second flange portion 7. One or more turns of wire in the first winding portion 3*c* may be wound in both of the section between the first contacting point 29 and the first flange portion 6 and the section between the second contacting point 30 and the second flange portion 7.

A variation of the above-described first embodiment is described here. In order to locate the contacting points 29 and 30, at which the first wire 3 and second wire 4 are in contact for the first time, at positions remote from the connection portions 3*a*, 3*b*, 4*a*, and 4*b*, to which heat for thermocompression bonding is provided, at least one turn of wire may be wound around the winding core portion 5 in a state where a section in the first winding portion 3*c* near the first extending portion 3*d* and a section in the second winding portion 4*c* near the third extending portion 4*d* are separated from each other and in a state where a section in the first winding portion 3*c* near the second extending portion 3*e* and a section in the second winding portion 4*c* near the fourth extending portion 4*e* are separated from each other.

Figure 5:
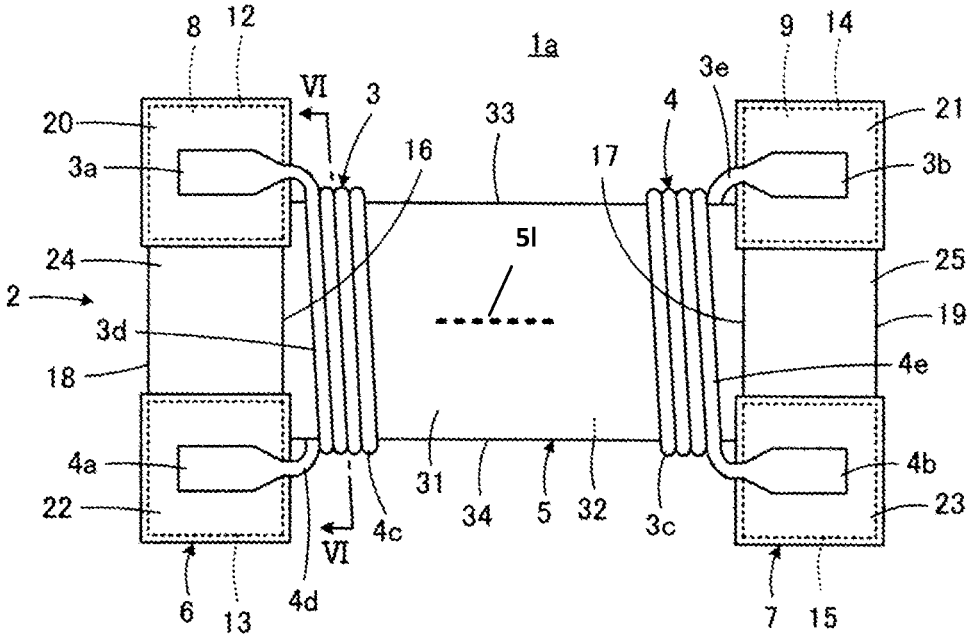
FIG. 5 is a bottom view that illustrates an external appearance of a coil component according to a second embodiment as seen from a mounting surface side.

Next, a coil component 1*a* according to a second embodiment is described with reference to FIGS. 5 and 6. The elements in FIGS. 5 and 6 corresponding to the elements illustrated in FIGS. 1 and 2 have the same reference numerals, and redundant description is omitted.

The second embodiment also adopts a configuration in which the first contacting point 29, at which the first wire 3 and second wire 4 are in contact for the first time, is located in positions remote from the connection portions 3*a*, 3*b*, 4*a*, and 4*b*, to which heat for thermocompression bonding is provided, although in different form from that of the first embodiment.

In the second embodiment, the dimensions of the winding core portion 5 have an important role. The winding core portion 5 includes a winding core portion bottom surface 31 facing a mounting substrate, a winding core portion top surface 32 facing a side opposite to the winding core portion bottom surface 31, and a pair of winding core portion side surfaces 33 and 34 facing mutually opposite directions and connecting the winding core portion bottom surface 31 and winding core portion top surface 32.

Characteristics of the second embodiment are described below. First, as illustrated in FIG. 5, the first connection portion 3*a* and third connection portion 4*a* are positioned outside an imaginary extended portion 51 extended along the axial direction of the winding core portion 5 as seen from a direction substantially orthogonal to the first flange portion bottom surface 8. Second, as illustrated in FIG. 6, the first connection portion 3*a* and third connection portion 4*a* are positioned outside an imaginary extended portion 5*p* extended from the winding core portion 5 toward the first flange portion bottom surface 8 as seen from the axial direction of the winding core portion 5. Here, the term outside indicates being outside an imaginary center line 51 (FIG. 5) or imaginary center plane 5*p* (FIG. 6), the imaginary center line 51 being the line in which the center line extending along the axial direction of the winding core portion 5 is extended in the axial direction, the imaginary center plane 5*p* being the plane including the center line and being substantially orthogonal to the first flange portion bottom surface 8.

Figure 6:
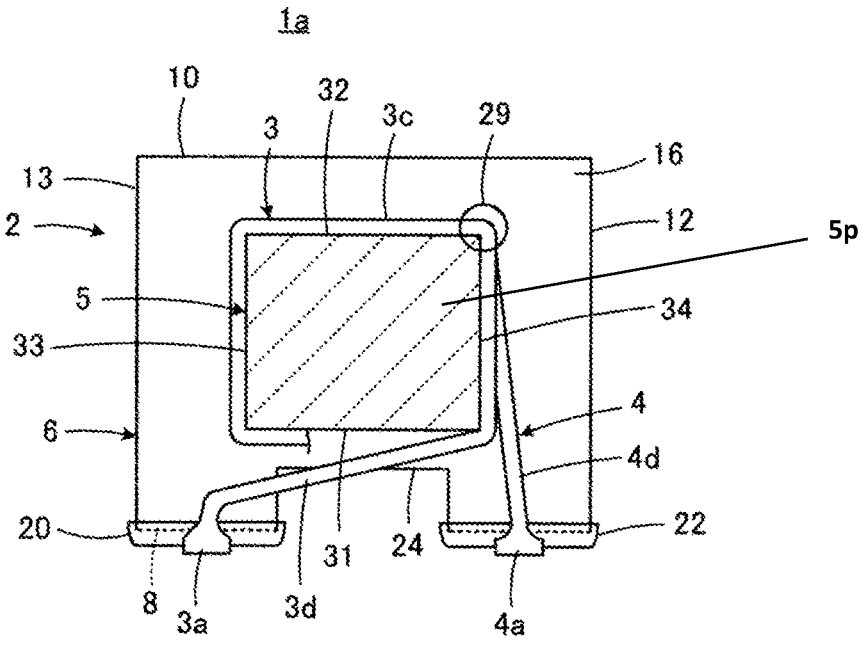
FIG. 6 is a cross-sectional view of the coil component taken along the line VI-VI in FIG. 5.

According to the second embodiment having the above characteristic configuration, as clearly indicated in FIG. 6, which illustrates the first flange portion 6, as seen in directions from the first extending portion 3*d* and third extending portion 4*d* toward the first winding portion 3*c* and second winding portion 4*c*, respectively, the contacting point 29, at which the first wire 3 and second wire 4 are in contact for the first time, can be located in a ridge portion formed between the winding core portion side surface 34 and winding core portion top surface 32. That is, the contacting point 29 can be located in the ridge portion formed between the winding core portion side surface 34 and winding core portion top surface 32, that ridge portion being more remote from the connection portions 3*a*, 3*b*, 4*a*, and 4*b*, in comparison with the configuration in which it is located in the ridge portion formed between the winding core portion bottom surface 31 and winding core portion side surface 34. Although not illustrated in FIG. 6, the same applies to the second contacting point 30.

Accordingly, in the second embodiment, as in the case of the first embodiment, a margin can be provided to the location where the modification of the coat 27 stops. In addition, if the temperature in the thermocompression bonding process is more raised, the arrival of heat at the contacting point 29, where the first wire 3 and second wire 4 are in contact for the first time, can be delayed. Therefore, the temperature in the thermocompression bonding process can be further raised. Consequently, the strength of coupling between the connection portions 3*a*, 3*b*, 4*a*, and 4*b* and the terminal electrodes 20 to 23 can be enhanced.

The coil component 1*a* according to the second embodiment does not include an element corresponding to the planar core 28 in the first embodiment.

Figure 7:
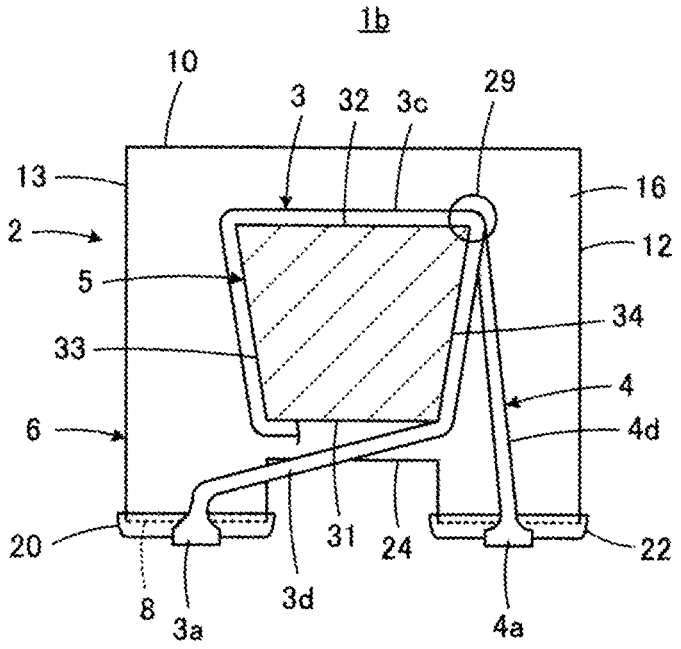
FIG. 7 is a cross-sectional view illustrating a coil component according to a third embodiment and corresponding to FIG. 6.

Next, a coil component 1*b* according to a third embodiment is described with reference to FIG. 7. FIG. 7 corresponds to FIG. 6. The elements in FIG. 7 corresponding to the elements illustrated in FIG. 6 have the same reference numerals, and redundant description is omitted.

The third embodiment is designed such that the advantages obtained from the second embodiment can be more reliably provided. That is, the dimension of the winding core portion bottom surface 31 measured in a direction substantially orthogonal to the axial direction of the winding core portion 5 is shorter than that of the winding core portion top surface 32. Thus, between the connection portions 3*a*, 3*b*, 4*a*, and 4*b* in the first wire 3 and second wire 4 and the contacting point 29, at which the first wire 3 and second wire 4 are in contact for the first time, the gap between the first wire 3 and second wire 4 can be larger than that in the second embodiment.

Accordingly, heat transmission between the first wire 3 and second wire 4 can be reduced, and heat dissipation between the connection portions 3*a*, 3*b*, 4*a*, and 4*b* and the contacting point 29 is promoted, and consequently, the arrival of heat at the contacting point 29 can be more delayed.

The plurality of embodiments are described above. Other various embodiments may be applied.

For example, the above-described embodiments relate to coil components constituting common mode choke coils. They may relate to coil components constituting other elements, such as transformers or baluns.

The above-described embodiments are illustrative, and their configurations may be replaced or combined in part between different embodiments.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

a drum core including a winding core portion extending in an axial direction, a first flange portion, and a second flange portion, the first and second flange portions being disposed on opposite end portions of the winding core portion;

a first wire and a second wire each including a linear central conductor and a coat made of resin and covering a peripheral surface of the central conductor;

a first terminal electrode and a third terminal electrode disposed on the first flange portion; and a second terminal electrode and a fourth terminal electrode disposed on the second flange portion, wherein the first wire includes a first connection portion connected to the first terminal electrode, a first winding portion wound around the winding core portion, a second connection portion connected to the second terminal electrode and being opposite to the first connection portion, a first extending portion between the first connection portion and the first winding portion, and a second extending portion between the second connection portion and the first winding portion, the second wire includes a third connection portion connected to the third terminal electrode, a second winding portion wound around the winding core portion, a fourth connection portion connected to the fourth terminal electrode and being opposite to the third connection portion, a third extending portion between the third connection portion and the second winding portion, and a fourth extending portion between the fourth connection portion and the second winding portion, the first extending portion and the third extending portion are out of contact with each other, the coat includes a first region made of a first resin containing a urethane group and a second region made of a second resin containing no urethane group, the coat in the first extending portion and the third extending portion is the second region at least in part, and the coat at a first contacting point where the first wire and the second wire are in contact for the first time from the first flange portion is the first region.

2. The coil component according to claim 1, wherein in either one of the first winding portion and the second winding portion, one or more turns of wire are wound between the first contacting point and the first flange portion.

3. The coil component according to claim 1, wherein the first flange portion and the second flange portion include a first flange portion bottom surface and a second flange portion bottom surface, respectively, the first and second flange portion bottom surfaces facing a mounting substrate when the coil component is mounted on the mounting substrate, and as seen from a direction orthogonal to the first flange portion bottom surface, the first connection portion and the third connection portion are positioned outside an imaginary extended portion extended from the winding core portion in the axial direction.

4. The coil component according to claim 3, wherein a dimension of a winding core portion bottom surface of the winding core portion measured in a direction orthogonal to the axial direction is shorter than that of a winding core portion top surface of the winding core portion, the winding core portion bottom surface facing the mounting substrate, the winding core portion top surface facing an opposite side to the winding core portion bottom surface.

5. The coil component according to claim 1, wherein the first winding portion and the second winding portion constitute a common mode choke coil.

6. The coil component according to claim 1, wherein the second resin is made of a resin in which the urethane group contained in the first resin is modified.

7. The coil component according to claim 1, wherein the first resin is polyurethane, and the second resin is polyester.

8. The coil component according to claim 1, wherein the second extending portion and the fourth extending portion are out of contact with each other, the coat in the second extending portion and the fourth extending portion is the second region at least in part, and the coat at a second contacting point where the first wire and the second wire are in contact for the first time from the second flange portion is the first region.

9. The coil component according to claim 2, wherein the first flange portion and the second flange portion include a first flange portion bottom surface and a second flange portion bottom surface, respectively, the first and second flange portion bottom surfaces facing a mounting substrate when the coil component is mounted on the mounting substrate, and as seen from a direction orthogonal to the first flange portion bottom surface, the first connection portion and the third connection portion are positioned outside an imaginary extended portion extended from the winding core portion in the axial direction.

10. The coil component according to claim 2, wherein the first winding portion and the second winding portion constitute a common mode choke coil.

11. The coil component according to claim 3, wherein the first winding portion and the second winding portion constitute a common mode choke coil.

12. The coil component according to claim 4, wherein the first winding portion and the second winding portion constitute a common mode choke coil.

13. The coil component according to claim 2, wherein the second resin is made of a resin in which the urethane group contained in the first resin is modified.

14. The coil component according to claim 3, wherein the second resin is made of a resin in which the urethane group contained in the first resin is modified.

15. The coil component according to claim 4, wherein the second resin is made of a resin in which the urethane group contained in the first resin is modified.

16. The coil component according to claim 5, wherein the second resin is made of a resin in which the urethane group contained in the first resin is modified.

17. The coil component according to claim 2, wherein the second extending portion and the fourth extending portion are out of contact with each other, the coat in the second extending portion and the fourth extending portion is the second region at least in part, and the coat at a second contacting point where the first wire and the second wire are in contact for the first time from the second flange portion is the first region.

18. The coil component according to claim 3, wherein the second extending portion and the fourth extending portion are out of contact with each other, the coat in the second extending portion and the fourth extending portion is the second region at least in part, and the coat at a second contacting point where the first wire and the second wire are in contact for the first time from the second flange portion is the first region.

19. The coil component according to claim 4, wherein the second extending portion and the fourth extending portion are out of contact with each other, the coat in the second extending portion and the fourth extending portion is the second region at least in part, and the coat at a second contacting point where the first wire and the second wire are in contact for the first time from the second flange portion is the first region.

20. The coil component according to claim 5, wherein the second extending portion and the fourth extending portion are out of contact with each other, the coat in the second extending portion and the fourth extending portion is the second region at least in part, and the coat at a second contacting point where the first wire and the second wire are in contact for the first time from the second flange portion is the first region.

* * * * *